US010000710B2

(12) United States Patent
Ferrughelli et al.

(10) Patent No.: US 10,000,710 B2
(45) Date of Patent: Jun. 19, 2018

(54) PYROLYSIS TAR UPGRADING PROCESS

(71) Applicant: ExxonMobil Chemical Patents Inc., Baytown, TX (US)

(72) Inventors: David T. Ferrughelli, Flemington, NJ (US); Emmanuel Ulysse, Maplewood, NJ (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 397 days.

(21) Appl. No.: 14/639,272

(22) Filed: Mar. 5, 2015

(65) Prior Publication Data

US 2015/0344790 A1 Dec. 3, 2015

Related U.S. Application Data

(60) Provisional application No. 62/004,393, filed on May 29, 2014.

(30) Foreign Application Priority Data

Jul. 7, 2014 (EP) ..... 14176021

(51) Int. Cl.

| | |
|---|---|
| ***C10G 47/06*** | (2006.01) |
| ***C10G 47/26*** | (2006.01) |
| ***C10G 49/04*** | (2006.01) |
| ***C10G 49/12*** | (2006.01) |
| ***C10G 69/06*** | (2006.01) |
| ***C10G 47/12*** | (2006.01) |
| ***C10G 45/14*** | (2006.01) |
| ***C10G 45/66*** | (2006.01) |
| ***C10G 47/24*** | (2006.01) |
| ***C10G 49/10*** | (2006.01) |

(52) U.S. Cl.

CPC ..... *C10G 47/06* (2013.01); *C10G 45/14* (2013.01); *C10G 45/66* (2013.01); *C10G 47/12* (2013.01); *C10G 47/24* (2013.01); *C10G 47/26* (2013.01); *C10G 49/04* (2013.01); *C10G 49/10* (2013.01); *C10G 49/12* (2013.01); *C10G 69/06* (2013.01)

(58) Field of Classification Search

CPC ..... C10G 47/06; C10G 47/26; C10G 49/04; C10G 49/12; C10G 69/06

See application file for complete search history.

(56) References Cited

U.S. PATENT DOCUMENTS

| | | | | |
|---|---|---|---|---|
| 3,622,502 A | | 11/1971 | Mason et al. | |
| 4,134,825 A | | 1/1979 | Aldridge et al. | |
| 4,192,735 A | * | 3/1980 | Aldridge | B01J 37/00 208/108 |
| 4,740,295 A | * | 4/1988 | Bearden, Jr. | B01J 23/28 208/108 |
| 5,024,751 A | | 6/1991 | Giuliani et al. | |
| 5,871,634 A | | 2/1999 | Wiehe et al. | |
| 2014/0061096 A1 | * | 3/2014 | Brown | C10G 69/06 208/73 |

FOREIGN PATENT DOCUMENTS

| | | | | |
|---|---|---|---|---|
| WO | 2012/051922 | | 4/2012 | |
| WO | WO 2013/033580 | * | 3/2013 | C10G 49/18 |

* cited by examiner

*Primary Examiner* — Renee Robinson

(57) ABSTRACT

A process for upgrading pyrolysis tar to higher value products. More particularly, this invention relates to the upgrading of steam cracker tar using relatively small amounts of a transition metal sulfide-containing particulate catalyst dispersed throughout the tar chargestock and in the presence of hydrogen, at relatively mild hydroconversion conditions.

25 Claims, No Drawings

PYROLYSIS TAR UPGRADING PROCESS

PRIORITY CLAIM

This application claims priority to and the benefit of U.S. Provisional Application No. 62/004,393, filed May 29, 2014, and European Application No. 14176021.5, filed Jul. 7, 2014, all of which are incorporated by reference in their entireties.

FIELD OF THE INVENTION

The invention relates to a process for upgrading pyrolysis tar to higher value products. More particularly, the invention relates to upgrading steam cracker tar using relatively small amounts of a transition metal sulfide-containing particulate catalyst dispersed throughout the tar chargestock and in the presence of hydrogen, at relatively mild hydroconversion conditions.

BACKGROUND

Pyrolysis processes, such as steam cracking, can be utilized for converting saturated hydrocarbons to higher-value products such as light olefins, e.g., ethylene and propylene. Besides these useful products, the pyrolysis of hydrocarbons can also produce a significant amount of undesirable, relatively low-value products, such as pyrolysis tar, e.g., steam-cracker tar ("SCT").

SCT is a high-boiling, viscous, reactive material comprising complex, ringed and branched molecules that can polymerize and foul equipment. SCT also contains high molecular weight non-volatile components including paraffin-insoluble compounds, such as pentane-insoluble ("PI") compounds and heptane-insoluble ("HI") compounds. The high molecular weight compounds are typically multi-ring structures that are also referred to as tar heavies ("TH"). These high molecular weight molecules can be generated during the steam cracking process, and their high molecular weight leads to high viscosity which limits desirable SCT disposition options. For example, it is desirable to find higher-value uses for SCT, such as for fluxing with heavy hydrocarbons, especially heavy hydrocarbons of relatively high viscosity. It is also desirable to be able to blend SCT with one or more heavy oils, examples of which include bunker fuel, burner oil, heavy fuel oil (e.g., No. 5 or No. 6 fuel oil), high-sulfur fuel oil, low-sulfur oil, regular-sulfur fuel oil ("RSFO"), and the like.

One difficulty encountered when blending heavy hydrocarbons is fouling that results from precipitation of high molecular weight molecules, such as asphaltenes. See, e.g., U.S. Pat. No. 5,871,634, which is incorporated herein by reference in it's entirely. In order to mitigate asphaltene precipitation, an Insolubility Number, $I_N$, and a Solvent Blend Number, $S_{BN}$, are determined for each blend component. Successful blending is accomplished with little or substantially no precipitation by combining the components in order of decreasing $S_{BN}$, so that the $S_{BN}$ of the blend is greater than the $I_N$ of any component of the blend.

Attempts at neat SCT hydroconversion to reduce viscosity and to improve both $I_N$ and $S_{BN}$, have not led to a commercializable process, primarily because fouling of process equipment could not be substantially mitigated. For example, neat SCT hydroconversion results in rapid catalyst coking when the hydroconversion is carried out at a temperature in the range of about 250° C. to 380° C., a pressure in the range of about 5400 kPa to 20,500 kPa, using a conventional hydroconversion catalyst containing one or more of Co, Ni, or Mo. This coking has been attributed to the presence of TH in the SCT. Although catalyst coking can be reduced by increasing hydrogen partial pressure, reducing space velocity, and operating at a lower temperature, SCT hydroconversion under such conditions is undesirable because increasing hydrogen partial pressures worsens process economics owing to increased hydrogen and equipment costs. Also, because of the increased hydrogen partial pressure, reduced space velocity, and reduced temperature range, an unacceptable level of undesired hydrogenation reactions can occur, leading to precipitation of the higher $I_N$ molecules.

Previous hydroconversion options using conventional hydroconversion process conditions and catalysts faced at least two major obstacles to commercialization. First, high-molecular weight SCT components, especially those having high-viscosity, low $S_{BN}$ and high $I_N$, can adsorb onto the catalyst surfaces. This led to excessive coking on catalyst, which by way of even more hydrogen starvation of aromatic molecules, resulted in poorer solubility of these molecules, eventually ending in process shutdown. Second, because of high hydrogen cost, aromatic ring saturation needed to be limited to prevent poor process economics.

One approach taken to overcome these difficulties is disclosed in International Patent Publication No. 2013/033580, which is incorporated herein by reference in its entirety. The application discloses hydroconverting SCT in the presence of a utility fluid comprising a significant amount of single and multi-ring aromatics. The hydroconverted tar product generally has a decreased viscosity, decreased atmospheric boiling point range, and increased hydrogen content over that of the SCT chargestock, resulting in improved compatibility with fuel oil and blend-stocks. The reference discloses a utility fluid having an ASTM D86 10% distillation point ≥60° C. and a 90% distillation point≤360° C. The amounts of utility fluid and SCT are in the range of from about 20.0 wt. % to about 95.0 wt. % of SCT and from about 5.0 wt. % to about 80.0 wt. % of utility fluid. Hydroprocessing conditions include a temperature in the range of about 50° C. to 500° C., an LHSV of the combined utility fluid/SCT in the range of about 0.1 $h^{-1}$ to 30 $h^{-1}$, a molecular hydrogen partial pressure in the range of about 0.1 MPa to 8 MPa, and a molecular hydrogen consumption rate of about 53 S $m^3/m^3$ to about 445 S $m^3/m^3$ based on the volume of SCT.

Although attempts have been made to develop a commercializable process for converting SCT to lower boiling more valued products, they have fallen short of this goal. Further improvements are therefore desired, e.g., improvements in decreasing the amount of catalyst required without significantly increasing process severity and/or decreasing the amount of utility fluid needed.

SUMMARY OF THE INVENTION

In accordance with certain aspects of the invention, there is provided a process for upgrading a pyrolysis tar chargestock, which process comprises conducting said pyrolysis tar chargestock to a hydroconversion zone for reacting the chargestock in the presence of a hydrogen-containing gas at hydroconversion conditions. The hydroconversion conditions include a temperature in the range of from about 380° C. to about 425° C. and a hydrogen partial pressure in the range of from about 500 psig (35 bar guage) to about 1,200 psig (82 bar guage). The process includes dispersing in the chargestock, at least one transition metal sulfide catalyst in particulate forms wherein the transition metal content is from about 10 wppm to about 1000 wppm, based on the weight of the chargestock. The transition metal can be selected from groups 4 to 10 of the Periodic Table of the Elements.

In certain aspects the transition metal sulfide catalyst is formed during a pretreatment step, the pretreatment step including (a) dissolving at least one oil-soluble compound of the transition metal in a hydrocarbon solvent and (b) reacting the resulting solution with a sulfur-containing material at a temperature in the range of about 325° C. to about 415° C., in the presence of a hydrogen-containing gas, to produce a transition metal sulfide catalyst in particulate form in the hydrocarbon solvent. The particulate+hydrocarbon solvent mixture is then introduced into the pyrolysis tar chargestock and subjected to hydroconversion conditions.

In another aspect the transition metal sulfide catalyst is formed in-situ in the chargestock by directly introducing an amount of an oil-soluble transition metal compound that is sufficient for forming the particulate catalyst in the pyrolysis tar chargestock. The resulting mixture of chargestock and oil-soluble transition metal compound is then exposed to hydroconversion conditions.

Certain aspects include producing the pyrolysis tar by steam cracking, e.g., steam cracking of a sour crude oil. Particularly when the steam cracker feed in a heavy oil, such as crude oil or a crude oil fraction, the pyrolysis tar can be produced in a steam cracking furnace having an integrated vapor-liquid separator.

DETAILED DESCRIPTION OF THE INVENTION

The following terms are defined for all purposes of this description and appended claims.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 20% of the mixture having a boiling point at atmospheric pressure that is ≥ about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a molecular weight ≥ about $C_{15}$. Pyrolysis tar generally has a metals content, $\leq 1.0\times10^3$ ppmw, based on the weight of the pyrolysis tar, e.g., an amount of metals that is far less than that found in crude oil (or crude oil components) of the same average viscosity.

"Tar Heavies", or TH, means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of pyrolysis tar that is not soluble in a 5:1 (vol.:vol.) ratio of n-pentane:Pyrolysis tar at 25.0° C. TH generally includes asphaltenes and other high molecular weight molecules.

The term "asphaltene or asphaltenes" means heptane insolubles, measured as described in A.S.T.M. D3279.

The term "Cn" hydrocarbon wherein n is a positive integer, e.g., 1, 2, 3, 4, or 5, means a hydrocarbon having n number of carbon atom(s) per molecule. The term "Cn+" hydrocarbon wherein n is a positive integer, e.g., 1, 2, 3, 4, or 5, means hydrocarbon having at least n number of carbon atom(s) per molecule. The term "Cn-" hydrocarbon wherein n is a positive integer, e.g., 1, 2, 3, 4, or 5, means hydrocarbon having no more than n number of carbon atom(s) per molecule. The term "aromatics" means hydrocarbon molecules containing at least one aromatic core. The term "substantially-saturated hydrocarbon" means hydrocarbon comprising ≤1.0 mole % of molecules which contain at least one double and/or at least one triple bond. The term "hydrocarbon" encompasses mixtures of hydrocarbon, including those having different values of n. The term "Periodic Table" means the Periodic Chart of the Elements, as appearing on the inside cover of The Merck Index, Twelfth Edition, Merck & Co., Inc., 1996.

The term "hydroprocessing" means processing of hydrocarbon in the presence of hydrogen, and encompasses the catalytic processing of hydrocarbon in the presence of a treat gas containing molecular hydrogen. Hydroprocessing can include, e.g., one or more of more of hydrotreating, hydroconverting, hydrocracking, hydrogenating, ring-opening, and related processes.

The term "oil soluble" with respect to a specified compound includes compounds which at least partially decompose when exposed to oil.

The term "invention" or "present invention" as used herein is a non-limiting term and is not intended to refer to any single aspect of the particular invention, but encompasses all aspects within the broader scope of the disclosure.

As used herein, the term "about" modifying the quantity of an ingredient or reactant refers to variation in the numerical quantity that can occur, for example, through typical measuring and liquid handling procedures used for making concentrates or solutions; through variation or error in these procedures; through differences in the manufacture, source, or purity of the ingredients employed to make the compositions or to carry out the procedures; and the like. The term "about" also encompasses amounts that differ as a result of different equilibrium conditions for a composition, as might arise from a particular initial mixture. Whether or not modified by the term "about", the claims appended hereto include equivalents to the specified quantities.

Pyrolysis tar can be produced by exposing a hydrocarbon-containing feed to pyrolysis conditions to produce a pyrolysis effluent. Typically, the pyrolysis effluent in a mixture comprising unreacted feed, unsaturated hydrocarbon produced from the feed during pyrolysis, and pyrolysis tar. For example, when a feed comprising ≥10.0 wt. % hydrocarbon, based on the weight of the feed, is subjected to pyrolysis, the pyrolysis effluent generally contains pyrolysis tar and ≥1.0 wt. % of $C_{2+}$ unsaturates, based on the total weight of the pyrolysis effluent. Typically, the pyrolysis tar comprises ≥90 wt. % of pyrolysis effluent molecules having a normal boiling point at atmospheric pressure ("atmospheric boiling point")≥290° C. Besides hydrocarbon, the feed to pyrolysis optionally contains a diluent, e.g., one or more of nitrogen, water, etc., e.g., ≥1.0 wt. % diluent based on the weight of a first mixture, such as ≥25.0 wt. %. When the diluent includes an appreciable amount of steam, the pyrolysis is referred to as steam cracking.

Aspects of the invention which include hydroprocessing SCT will now be described in more detail. The invention is not limited to these aspects, and this description is not meant to foreclose other aspects within the broader scope of the invention, such as those which include the hydroprocessing of other pyrolysis tars.

SCT generally comprises a significant amount of TH, which are typically solid at 25° C. The TH generally includes high-molecular weight molecules (e.g., MW≥600) such as asphaltenes and other high-molecular weight hydrocarbons. For example, the TH can comprise ≥10.0 wt. % of high molecular-weight molecules having aromatic cores that are linked together by one or more of: (i) relatively low molecular-weight alkanes and/or alkenes, e.g., $C_1$ to $C_3$ alkanes and/or alkenes; (ii) $C_5$ and/or $C_6$ cycloparaffinic rings; or (iii) thiophenic rings. Generally, ≥60.0 wt. % of the TH's carbon atoms are included in one or more aromatic cores based on the weight of the TH's carbon atoms, e.g., in the range of 68.0 wt. % to 78.0 wt. %. While not wishing to be bound by any theory or model, it is also believed that the TH form aggregates having a relatively planar morphology as a result of Van der Waals attraction between the TH molecules.

The large size of the TH aggregates, which can be in the range of, e.g., ten nanometers to several hundred nanometers ("nm") in their largest dimension, leads to relatively low aggregate mobility and diffusivity under catalytic hydroconversion conditions. In other words, conventional TH conversion suffers from severe mass-transport limitations, which results in a high selectivity for TH conversion to coke. Although it has been reported that combining SCT with a utility fluid believed to break down the aggregates into individual molecules of, e.g., ≥5.0 nm in their largest dimension and a molecular weight in the range of about 200 grams per mole to 2500 grams per mole, it has been found that hydroprocessing in the presence of a particulate catalyst under the specified conditions, leads to greater mobility and diffusivity of the SCT's TH, even when little or no utility fluid is utilized. In other words, a shorter catalyst-contact time and less conversion to coke is observed when using the specified hydroprocessing condition, including a pressure in the range of from e.g., 500 psig to 1500 psig (34.5 bar guage to 103.4 bar gauge) even when little or no utility fluid is utilized. This in turn leads to a significant reduction in cost and complexity over higher-pressure SCT hydroprocessing, and SCT hydroprocessing in the presence of a significant amount of utility fluid.

The SCT used in the practice of the present invention can be obtained from any suitable steam cracking process. Conventional steam cracking utilizes a pyrolysis furnace that has two main sections: a convection section and a radiant section. The feedstock generally comprises a mixture (a first mixture) comprising hydrocarbon and water, generally in the form of steam. The first mixture typically enters the convection section of the furnace where the first mixture's hydrocarbon is heated and vaporized by indirect contact with hot flue gas from the radiant section and by direct contact with the first mixture's steam. The resulting steam-vaporized hydrocarbon mixture is then introduced into the radiant section where the bulk of cracking takes place. A second mixture is conducted away from the pyrolysis furnace, the second mixture comprising products resulting from the pyrolysis of the first mixture and any unreacted components of the first mixture. At least one separation stage is generally located downstream of the pyrolysis furnace, the separation stage being utilized for separating from the second mixture one or more of the light olefins, steam cracked naphtha ("SCN"), steam cracked gas oil ("SCGO"), SCT, water, unreacted hydrocarbon components of the first mixture, etc. The separation stage can comprise, e.g., a primary fractionator. Generally, a cooling stage, typically either direct quench or indirect heat exchange, is located between the pyrolysis furnace and the separation stage. Besides SCT, pyrolysis furnaces generally produce: (i) vapor-phase products, generally $C_{4-}$, such as one or more of acetylene, ethylene, propylene, butenes; and (ii) liquid-phase products comprising, e.g., one or more of $C_{5+}$ molecules and mixtures thereof. The liquid-phase products are generally conducted to the separation stage, e.g., a primary fractionator, for separation of one or more of: (a) overheads comprising SCN, (e.g., $C_5$ to $C_{10}$ species) and SCGO, the SCGO comprising >90 wt. %, based on the weight of the SCGO of molecules (e.g., $C_{10}$ to $C_{17}$ molecules) having an atmospheric boiling point in the range of about 400° F. to about 500° F. (200° C. to 290° C.) and; (b) bottoms comprising >90 wt. % SCT, based on the weight of the bottoms, the SCT having a boiling range > about 550° F. (290° C.) and comprising molecules and mixtures thereof having a molecular weight $>C_{15}$.

Optionally, the pyrolysis furnace has at least one vapor-liquid separator (sometimes referred to as flash pot or flash drum) integrated therewith. U.S. Patent Application No. 61/986,316, which is incorporated herein by reference in its entirety, describes the integration of such a vapor-liquid separator. The vapor-liquid separator is used for upgrading the first mixture before exposing it to pyrolysis conditions in the furnace's radiant section. It can be desirable to integrate a vapor-liquid separator with the pyrolysis furnace when the first mixture's hydrocarbon comprises ≥1.0 wt. % of non-volatiles, e.g., ≥5.0 wt. %, such as 5.0 wt. % to 50.0 wt. % of non-volatiles having a nominal boiling point ≥1400° F. (760° C.). It is particularly desirable to integrate a vapor/liquid separator with the pyrolysis furnace when the non-volatiles comprise asphaltenes, such as first mixture's hydrocarbon comprises ≥ about 0.1 wt. % asphaltenes based on the weight of the first mixture's hydrocarbon component, e.g., about 5.0 wt. %. Generally, when using a vapor-liquid separator, the composition of the vapor phase leaving the separator device is substantially the same as the composition of the vapor phase entering the separator, and likewise the composition of the liquid phase leaving the separator is substantially the same as the composition of the liquid phase entering the separator. In other words, the separation in the vapor-liquid separator includes (or even consists essentially of) a physical separation of the two phases entering the separator.

When integrating at least one vapor-liquid separator with a pyrolysis furnace, at least a portion of the first mixture's hydrocarbon is provided to the inlet of the furnace's convection section, wherein hydrocarbon is heated so that at least a portion of the hydrocarbon is in the vapor phase. When a diluent (e.g., steam) is utilized, the first mixture's diluent is optionally (but preferably) added in this section and mixed with the hydrocarbon to produce the first mixture. The first mixture, at least a portion of which is in the vapor phase, is then flashed in the vapor-liquid separator in order to separate and conduct away from the first mixture at least a portion of the first mixture's non-volatiles, e.g., high molecular-weight non-volatile molecules, such as asphaltenes. A bottoms fraction can be conducted away from the vapor-liquid separator, the bottoms fraction comprising, e.g., ≥10.0% (on a wt. basis) of the first mixture's non-volatiles, such as ≥10.0% (on a wt. basis) of the first mixture's asphaltenes.

One of the advantages of using an integrated vapor-liquid separator is reducing the amount of $C_{6+}$ olefin in the SCT, particularly when the first mixture's hydrocarbon has relatively high asphaltene content and relatively low sulfur content. Such hydrocarbons include, for example, those having: (i) ≥ about 0.1 wt. % asphaltenes based on the weight of the first mixture's hydrocarbon, e.g., ≥ about 5.0 wt. %; (ii) a final boiling point ≥600° F. (315° C.), generally ≥950° F. (510° C.), or >1100° F. (590° C.), or ≥1400° F. (760° C.); and optionally (iii)≤5 wt. % sulfur, e.g., ≤1.0 wt. % sulfur, such as <0.1 wt. % sulfur. It is observed that using an integrated vapor-liquid separator when pyrolysing these hydrocarbons in the presence of steam, the amount of olefin in the resulting SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is reduced because precursors in the first mixture's hydrocarbon that would otherwise form $C_{6+}$ olefin in the SCT are separated from the first mixture in the vapor-liquid separator and removed from the process before the pyrolysis. Evidence of this feature is found by comparing the density of SCT obtained by crude oil pyrolysis. For conventional steam cracking of a crude oil fraction, such as vacuum gas oil, the SCT is observed to have an API gravity (measured at 15.6° C.) the range of about −1° API to about 6° API. API gravity is an inverse measure of the relative density, where a lesser (or more negative) API gravity value is an indication of greater SCT density. When the same hydrocarbon is pyrolyzed, utilizing an integrated vapor-liquid separator operating under the specified conditions, the SCT density is increased, e.g., to an API gravity ≤−7.5° API, such as ≤−8.0° API, or ≤−8.5° API.

Another advantage of integrating a vapor/liquid separator with the pyrolysis furnace is that it increases the range of hydrocarbon types available for use directly, without hydrocarbon pre-processing, in the first mixture. For example, the first mixture's hydrocarbon can comprise ≤50.0 wt. %, e.g., ≥75.0 wt. %, such as ≥90.0 wt. % (based on the weight of the first mixture's hydrocarbon) of one or more crude oils, even high naphthenic acid-containing crude oils and fractions thereof. Feeds having a high naphthenic acid content are among those that produce a high quantity of SCT and are especially suitable when at least one vapor/liquid separator is integrated with the pyrolysis furnace. If desired, the first mixture's composition can vary over time, e.g., by utilizing a first mixture having a first hydrocarbon during a first time period and then, during a second time period, substituting a second hydrocarbon for at least a portion of the first hydrocarbon. The first and second hydrocarbons can be substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This can be utilized for the sequential pyrolysis of incompatible first and second hydrocarbon components (i.e., where the first and second hydrocarbon components are mixtures that are not sufficiently compatible to be combined in the first mixture). For example, the first mixture can comprise a first hydrocarbon during a first time period and a second hydrocarbon (one that is substantially incompatible with the first hydrocarbon) during a second time period. In certain aspects, the first hydrocarbon can comprise, e.g., a virgin crude oil, and the second hydrocarbon can comprise SCT.

Certain aspects of the invention are based in part on the discovery that a carbon-supported transition metal sulfide catalyst, in dispersed form (such as dispersed carbon-supported $MoS_2$), will effectively and efficiently convert SCT to less viscous products having more favorable $S_{BN}$ and $I_N$ values, provided that hydroconversion is carried out at a temperature and pressure that are substantially less severe than conventional hydroconversion conditions utilized for converting heavy hydrocarbon feedstocks with a dispersed catalyst. It has also been unexpectedly found that this conversion can be carried out at relatively long run lengths, with little or no reactor plugging, even when using little or no utility fluid.

U.S. Pat. No. 4,134,825, which is incorporated herein by reference in its entirety, discloses hydroconverting petroleum crudes and resids using a highly dispersed transition meal catalyst at a temperature in the range of about 343° C. to 538° C., and at pressures from about 500 psig (34 bar gauge) to 5000 psig (340 bar gauge). It has been found that hydroprocessing pyrolysis tar, especially SCT, using substantially the same catalysts as is used in that patent, results in an undesirable increase in the SCT's $I_N$ when hydroconversion is carried out at a temperature ≥425° C. It has also been found that an undesirable increase in molecular hydrogen consumption occurs at these temperature when the molecular hydrogen partial pressure is ≥68 bar(g) (about 986 psig). These difficulties are now overcome, resulting in a commercially feasible SCT hydroconversion process, by utilizing a unique set of process conditions and catalyst heretofore not used for the upgrading of pyrolysis tar, especially SCT. While not wishing to be bound by any theory or model, it is believed that the specified process conditions and catalyst are needed because the high molecular weight molecules present in pyrolysis tar, such as TH in SCT, are substantially different from those of other heavy hydrocarbons, such as petroleum crudes, petroleum tars, resids, and bitumens. These differences have led to the development of processes for hydroprocessing pyrolysis tar, such as SCT, in the presence of the specified particulate catalyst. The hydroprocessing conditions include exposing the pyrolysis tar and dispersed catalyst to a temperature in the range from about 380° C. to about 425° C., such as in the range from about 380° C. to about 400° C., and a hydrogen partial pressure in the range of about 500 psig (34 bar gauge, "barg") to about 1200 psig (83 barg), preferably about 800 (55 barg) to about 1000 psig (69 barg).

It was expected that hydroprocessing SCT under more severe conditions than those specified, e.g., a temperature >425° C. and with a molecular hydrogen partial pressure ≥100 bar(g), would both improve the blending properties of SCT and increase hydroprocessing run length. The higher temperature and pressure were believed to be needed to increase conversion of SCT molecules, having an atmospheric boiling point ≥1050° F. (≥565° C.), decrease the SCT's nitrogen and sulfur content, and decrease reactor coking, in order to produce a hydroconverted SCT of relatively low viscosity and compatible blend numbers. Contrary to these expectations, it has been found that this is not the case. It has now been found that when SCT is hydroprocessed in accordance with the invention, a substantial amount of SCT molecules depolymerized when exposed to a temperature ≥ about 310° C. (up to about 400° C.) under the specified hydroprocessing conditions. Increasing the temperature beyond > about 425° C. is observed to only slightly increase conversion of SCT molecules having an atmospheric-boiling point ≥565° C. But doing so had a significant negative effect: the resulting a hydroprocessed product has a higher $I_N$ than that of hydroprocessed product produced using hydroprocessing conditions specified for the invention. The large $I_N$ is believed to result from the presence of molecules which will make foulants such as coke when exposed to higher temperatures.

While not wishing to be bound by any theory or model, it is believed that hydroprocessing pyrolysis tar such as SCT in the presence of a particulate catalyst under the relatively mild conditions specified results from the physical and chemical differences between pyrolysis tar and high molecular weight petroleum based hydrocarbon mixtures, which require more severe conditions. SCT differs from high-molecular weight petroleum-based hydrocarbon mixtures in that the aromatic carbon content of SCT, e.g., as measured by $^{13}C$ NMR. It has been observed that the aromatic carbon content of SCT, is substantially greater than that of high molecular weight petroleum-based hydrocarbon, such as vacuum resid. For example, the amount of aromatic carbon in SCT is typically greater than about 70 wt. % while the amount of aromatic carbon in petroleum resid is generally less than about 40 wt. %. A significant fraction of the SCT asphaltenes have an atmospheric boiling point that is less than 565° C., for example only about 32.5 wt. % of asphaltenes in SCT have an atmospheric boiling point greater than 565° C. This is not the case with vacuum resid. The asphaltenes in vacuum resid are mostly heavy molecules having atmospheric boiling points that are greater than 565° C. When subjected to heptane solvent extraction, under substantially the same conditions as those used for vacuum resid, the asphaltenes obtained from SCT, contain a substantially greater percentage (on wt. basis) of molecules having an atmospheric boiling point less than about 565° C. than is the case for vacuum resid.

It has also been unexpectedly found that high molecular weight SCT molecules, particularly SCT asphaltene molecules: (i) are polymeric in structure; and (ii) have mostly $C_1$ to $C_3$ bonds between aromatic cores which cleave at relatively low temperatures, even at temperatures ≤425° C. The linkages between SCT asphaltene constituents that are formed during steam cracking were found to be different than asphaltenes from virgin crudes and resids. For example, linkages between SCT asphaltene constituents are no more than about 1 to 3 carbons while virgin crude asphaltenes have much longer aliphatic chains. The aromaticity of SCT tar is >70% while crude and petroleum resid asphaltenes are generally no more than 30% to 40% on a weight basis.

Although the SCT's total carbon is only slightly higher and the oxygen content (wt. basis) is similar to that of resid, the SCT's olefin, metals, hydrogen, and nitrogen (wt. basis) range are considerably lower. The total amount of metals in a typical SCT is generally less than about 1000 ppmw (parts per million, weight) based on the weight of the SCT, e.g., less than or equal to about 100 ppmw, such as less than or equal to 10 ppmw. The total amount of nitrogen present in SCT is generally less than the amount of nitrogen present in a crude oil vacuum resid. The sulfur content of SCT can vary from tenths of 1 wt. % to several wt. % (e.g. ≥1 wt. %, such or ≥3 wt. %, or ≥5 wt. %), depending on the feed used to produce the SCT. The amount of olefin, including vinyl aromatics, in the SCT is generally ≤10.0 wt. % based on the weight of the set, e.g., ≤5.0 wt. %, such as ≤2.0 wt. %. Generally lower olefin amounts in the SCT are observed when the SCT is produced by (i) steam cracking a crude oil or crude oil fraction containing ≥0.1 wt. % sulfur, based on the weight of the crude oil or crude oil fraction, or (ii) steam cracking a crude oil or crude oil fraction in the pyrolysis furnace having one or more integrated vapor-liquid separators. Further, the amount of aliphatic carbon and the amount of carbon in long chains is substantially lower in SCT compared to resid. The SCT's kinematic viscosity at 50° C. it generally greater than about 100 cSt, or greater than 1000 cSt even though the relative amount of SCT having an atmospheric boiling point greater than or equal to 565° C. is substantially less than is the case for resid. The table below list several distinguishing properties of SCT compared to typical petroleum-based tars and resids, such as vacuum resid.

| Property | VR | SCT |
|---|---|---|
| H/C (average) | 1.4 | 0.84 to 0.95 |
| Vanadium (pp | 300 | 0 to 2 |
| Nickel (ppm) | 100 | 0 to 2 |
| % NHI* (wt. %) | 0 to 25 | 20 to 40 |
| Aromatic Carbon | 30 to 40 | 70 to 75 |
| Aliphatic Carbon | 60 to 75 | 20 to 30 |
| Wt. % Asphaltenes Bp >565° C. | >75 | 15 to 32 |
| Wt. % C in long chains (5 carbons) | 10 to 20 | 0.5 to 0.8 |

*NHI = normal heptane insolubles as a measurement of asphaltenes.

Differences in the above properties can be attributed to a number of factors, one of which is that SCT has been stripped by the steam cracking process resulting in aromatic cores that have methyl groups as pendants and short $C_1$ to $C_3$ linkages between cores. Vacuum resid asphaltenes are typically very aliphatic and have longer side chains than SCT asphaltenes.

Aspects of the invention relating to certain particulate catalysts will now be described in more detail. The invention is not limited to these aspects, and this description is not meant to foreclose other particulate catalysts within the broader scope of the invention.

In certain aspects, the invention relates to catalytic particles, which are substantially-uniformly dispersed in the pyrolysis tar chargestock. It is believed that dispersing the particulate catalyst in the chargestock lessens the distance between catalyst particles and shortens the time needed for a reactant molecule (e.g., a TH molecule) or intermediate thereof, to become proximate to catalyst sites which are active for hydroprocessing.

The particulate catalyst is generally formed from an oil-soluble metal compound. The particulate catalyst can be formed from the compound (i) in a pretreatment step in the presence of solvent and/or (ii) in-situ by adding the oil-soluble metal compound to the pyrolysis tar chargestock. It has been found that exposing the combined [chargestock+ oil-soluble metal compound] to the specified hydroprocessing conditions results in both (i) forming and dispersing the particulate catalyst in the chargestock and (ii) catalytic hydroprocessing of the chargestock's pyrolysis tar to produce the desired hydroprocessed product. When the particulate catalyst is formed during pretreatment, the amount of transition metal (the catalytic metal) on and/or in the particulate catalyst is generally in the range of from 10 wt. % to 40 wt. % of transition metal on carbon derived from the pretreatment solvent, based on the weight of the particulate catalyst, e.g., in the range of from 20 wt. % to 30 wt. %. When the particulate catalyst is formed during pyrolysis tar hydroprocessing (in-situ particulate catalyst formation), the amount of the transition metal on and/or in the particulate catalyst is generally in the range of from 10 wt. % to 40 wt. % of transition metal on carbon derived from the pyrolysis tar, based on the weight of the particulate catalyst, e.g., in the range of from 20 wt. % to 30 wt. %. The resulting particulate catalyst is optionally non-colloidal. Optionally, substantially all of the particulate catalyst is in the solid-phase during the hydroprocessing.

In certain aspects, the oil-soluble metal compound, includes at least one compound of one or more metals selected from Groups 4 to 10 of the Periodic Table Non-limiting examples of such metals include titanium, zirconium, vanadium, niobium, tantalum, chromium, molybdenum, tungsten, manganese, rhenium, iron, cobalt, nickel and the noble metals including platinum, iridium, palladium, osmium, ruthenium and rhodium. Preferred metals are selected from the group consisting of molybdenum, vanadium and chromium, more preferably molybdenum and chromium, and most preferably molybdenum. The particulate catalyst of the invention does not require the use of a non-particulate supported, hydroprocessing catalyst, although the invention is compatible with a combination of the dispersed particulate catalyst with a non-particulate hydroprocessing catalyst. The amount of oil-soluble metal compound in the pyrolysis tar undergoing hydroprocessing can be in the range of about 10 to about 1000 wppm, preferably from about 50 to 300 wppm, and more preferably from about 50 to 200 wppm, based on the weight of the pyrolysis tar or pretreatment solvent as the case may be.

Suitable oil-soluble metal compounds that are convertible to the desired particulate catalyst (under the specified process conditions) include: (1) inorganic metal compounds such as halides, oxyhalides, heteropoly acids (e.g., phosphomolybdic acid, molybdosilicic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans; xanthic acid; phenols, di and polyhydroxy aromatic compounds; (3) organometallic compounds such as metal chelates, e.g. with 1,3-diketones, ethylene diamine, ethylene diamine tetraacetic acid, phthalocyanines, etc., and (4) metal salts of organic amines such as aliphatic amines, aromatic amines, and quaternary ammonium compounds.

In certain aspects, the oil-soluble metal compounds include salts of acyclic (straight or branched chain) aliphatic carboxylic acids, salts of alicyclic aliphatic carboxylic acids, heteropolyacids, carbonyls, phenolates and organo amine salts. The more preferred metal compounds are salts of alicyclic aliphatic carboxylic acids such as metal naphthenates. The most preferred compounds are molybdenum naphthenate, vanadium naphthenate, and chromium naphthenate.

Those skilled in the art will appreciate that more than one method is suitable for converting the oil-soluble metal compound to the specified particulate catalyst. One suitable method includes forming at least a portion of the particulate catalyst in solution during a pretreatment step, separating the formed particulate catalyst from the pretreatment solution, and then introducing the particulate catalyst into the chargestock. Accordingly, in certain aspects, a predetermined amount of oil-soluble metal compound is added to a pretreatment solvent to produce a pretreatment solution. The pretreatment solution is heated, in the presence of a hydrogen-containing treat gas and a sulfur donor material, to a temperature which results in the formation of a sulfided metal catalyst in particulate form. Those skilled in the art will appreciate that the sulfur donor material can be introduced into the pretreatment via, e.g., the pretreatment solvent or the hydrogen-containing treat gas. Generally at least a stoichiometric amount of sulfur donor is used based on the amount of catalytic metal, to produce a sulfided catalyst. The pretreatment solvent can be any suitable hydrocarbon solvent in which the oil-soluble metal compound will effectively decompose disperse, or dissolve. Non-limiting examples of such solvents include petroleum resids, both atmospheric and vacuum, or a portion of the pyrolysis tar chargestock itself. It is preferred to use a portion of the pyrolysis tar chargestock because of its high aromaticity and low metals content. The catalyst can form by heating the solution to a temperature in the range of from about 325° C. to about 415° C., and a pressure in the range of about 500 psig (34 barg) to about 3,000 psig (207 barg). If hydrogen-sulfide is used as a sulfur donor provided to the pretreatment as a component of the hydrogen-containing treat gas, the hydrogen-containing treat gas comprises from about 1 to about 90 mole percent of hydrogen sulfide, preferably from about 2 to about 50 mole percent, more preferably from about 2 to about 30 mole percent. In certain aspects, the hydrogen-containing treat gas comprises about 1 to about 10 mole percent of hydrogen sulfide, e.g., from about 2 to 10 mole percent. The pretreatment, in the presence of hydrogen or in the presence of hydrogen and hydrogen sulfide, is believed to convert the metal compound to the corresponding metal-containing solid, non-colloidal particulate catalyst that are catalytically active for pyrolysis tar hydroprocessing and also act as coking inhibitors.

Once the particulate catalyst is formed it can be removed from the solvent. Conventional catalyst removal methods can be utilized to do this e.g., filtration, but the invention is not limited thereto. In certain embodiments, after removing the catalyst from the solvent, at least a portion of the removed catalyst can be introduced directly into the chargestock. The remainder of the removed catalyst can be stored for later use. In other aspects at least a fraction of the solution containing the catalyst can be introduced into the chargestock, which is then subjected to hydroprocessing under the specified conditions.

Other aspects of the invention include producing at least a portion of the particulate catalyst by converting the oil-soluble metal compound in the pyrolysis tar chargestock. The oil-soluble compound can be introduced directly into the pyrolysis tar and the resulting mixture subjected to hydroprocessing conditions. In other words, no solvent or utility fluid is needed. Should the pyrolysis tar contain insufficient sulfur for effectively sulfiding the catalytic metal, at least one sulfur donor (e.g., hydrogen-sulfide) can be added, e.g., via the hydrogen-containing treat gas. For example, hydrogen sulfide can be provided as a component of the hydrogen-containing treat gas. In these aspects, the hydrogen-containing treat gas can comprise from about 1 to about 90 mole percent of hydrogen sulfide, preferably from about 2 to about 50 mole percent, more preferably from about 2 to about 30 mole percent. In certain aspects, the hydrogen-containing treat gas comprises about 1 to about 10 mole percent of hydrogen sulfide, e.g., from about 2 to 10 mole percent. The conversion of the metal compound in the presence of the hydrogen and hydrogen sulfide is believed to produce the corresponding metal-containing solid, non-colloidal catalyst. Whatever the exact nature of the resulting metal-containing catalyst, the resulting metal component of the particulate catalyst acts as a catalytic agent and a coking inhibitor. When an oil-soluble molybdenum compound is used as the catalyst precursor, the preferred method of converting the oil-soluble metal compound is in situ in the hydroprocessing zone, without any pretreatment.

In certain aspects, the chargestock comprises ≥90 wt. % of pyrolysis tar based on the weight of the chargestock, e.g., ≥95 wt. %, such as ≥99 wt. %, or even ≥98.9 wt. %. The pyrolysis tar can comprise a major amount of SCT, e.g., ≥95 wt. % SCT, based on the weight of the pyrolysis tar, such as ≥99.0 wt. %. In certain aspects, the chargestock consists essentially of or consists of SCT. Hydroprocessing conditions will now be described in more detail, these conditions being suitable for converting an SCT chargestock to a hydroprocessed tar product that can be blended with heavy fuel oil without appreciable asphaltene precipitation. The invention is not limited to these conditions, and this description is not meant to foreclose other process conditions within the broader scope of the invention.

Certain aspects of the invention include exposing an SCT chargestock to a temperature in the range of from about 380° C. to about 425° C., and a hydrogen partial pressure ranging from about 500 psig (34 barg) to 1200 psig (83 barg), e.g., from about 800 psig (55 barg) to about 1000 psig (69 barg). Contact of the SCT chargestock under the specified hydroconversion conditions with the hydrogen-containing treat gas is generally carried out in one or more reaction zones and converts the oil-soluble metal compound to the corresponding metal sulfide catalyst in situ while simultaneously producing a hydroprocessed tar, in this case a hydroprocessed SCT. The particulate catalyst is generally an amount sufficient to provide a transition metal content in the range of about 10 ppmw to about 1000 ppmw, based on the weight of the SCT. When present in this range the mixture of {SCT+particulate catalyst} can be in the form of a slurry. Besides hydroprocessed SCT, the reaction zone effluent contains solids, which can be separated from the hydroprocessed SCT by conventional means, for example, by settling or centrifuging or filtration. At least a portion of the separated solids, or solids concentrate, can be recycled directly to the hydroprocessing zone, or recycled to the SCT chargestock. Makeup catalyst components can be added in the process where and when needed. The space velocity, defined as volumes of oil feed per hour per volume of reactor (V/hr./V), may vary widely depending on the desired hydroconversion level. Typical space velocities can range broadly from about 0.1 to 10 volumes of oil feed per hour per volume of reactor, preferably from about 0.25 to 6 V/hr./V, more preferably from about 0.5 to 2 V/hr./V. The process of the invention can be conducted in batch and/or continuous operation.

The specified particulate catalysts are used for pyrolysis tar hydroprocessing at hydrogen partial pressures that all substantially lower (500-1200 psig, 34 barg-82 barg) than conventional hydroconversion which typically include hydrogen partial pressures (1500-3000 psig, 102 barg-204 barg). The amount of particulate catalyst use is relatively small compared to the amount needed when a non-particulate catalyst is used for pyrolysis tar hydroprocessing. For example, even when the non-particulate catalyst is present in an amount ≤1000 ppwm based on the weight of the pyrolysis tar, ≥10 wt. %, e.g., ≥50 wt. %, such as ≥90 wt. % of the pyrolysis tar in the chargestock is converted to the desired hydroprocessed tar product with little or no coke make.

Substantially no aromatic rings are saturated during the pyrolysis tar hydroprocessing. The process has a relatively low $H_2$ consumption because, further, a significant amount, about 70% to 75%, of the heptane insoluble molecules (primarily asphaltenes) in the pyrolysis tar, are converted, along with a viscosity reduction of about 95 to 98%, preferably from about 97 to 98%. That is 70-75% of the total asphaltenes of the pyrolysis tar chargestock are converted, and up to 90% of the higher $I_N$ asphaltenes are converted, which is important for blending options to avoid precipitation of asphaltenes. This enables an increase in blending options since a relatively expensive flux hydrocarbon fluid is not needed to prevent asphaltine precipitation curing blending of the hydroprocessed pyrolysis tar. With use of lower $H_2$ pressures, the cost of running the process of the present invention is substantially less than that needed for conventional hydroprocessing. Another contributing factor for favorable economics of the present pyrolysis tar hydroprocessing process is that standard metallurgy can be used for process equipment instead of the more expensive higher pressure equipment that is needed for conventional hydroprocessing.

When hydroprocessed under the specified conditions, the pyrolysis tar is converted to a hydroprocessed pyrolysis tar, e.g., hydroprocessed SCT. The hydroprocessed pyrolysis tar has improved properties compared to the pyrolysis tar chargestock, which makes the hydroprocessed pyrolysis tar particularly suitable for use as a fuel oil blending component. Blending of the hydroprocessed pyrolysis tar with other heavy hydrocarbons can be accomplished with little or no asphaltene precipitation, even without further processing of the hydroprocessed tar prior to the blending. For example, when an SCT chargestock is hydroprocessed using the specified particulate catalyst under the specified conditions, the hydroconverted SCT generally exhibits improved viscosity, $S_{BN}$, and $I_N$ over the SCT chargestock. The SCT's viscosity generally exceeds that of the hydroconverted SCT by a factor of ≥10, e.g., ≥20, such as ≥40, or even ≥60. The hydroconverted SCT's $S_{BN}$ generally exceeds that of the SCT chargestock by a factor of ≥1.05, e.g., ≥1.10, such as ≥1.20. The amount of sulfur in the hydroconverted SCT (wt. basis) is less than that of the SCT chargestock, even though the hydrogen content of the hydroconverted SCT is substantially the same as that of the SCT chargestock. For example, hydroprocessing SCT under the specified conditions can produce a hydroconverted SCT having within +/−1% of hydrogen content (wt. basis) compared to that of the SCT chargestock, but having a sulfur content that is at least 20% less than that of the SCT chargestock, e.g., less than about 25% (wt. basis).

While not wishing to be bound by any particular theory or model, it is believed that when SCT conversion is carried out at a temperature ≤425° C., in the presence of molecular hydrogen, and a dispersed transition metal sulfide catalyst of the present invention, the following reactions occur. First, at least a portion of the SCT's high molecular weight molecules are broken into fragments. Second, at least a portion of the unsaturated bonds produced during the fragmentation are hydrogenated, substantially preventing recombination of the heavy SCT molecules of greater insolubility (higher $I_N$). Preventing the formation of higher-$I_N$ molecules has at least two significant benefits: (a) it improves the blending characteristics of the SCT with other heavy hydrocarbons, and (b) less coking (and longer run lengths) can be achieved in the hydroprocessing reactor, even at relatively low to moderate molecular hydrogen partial pressure. Although the use of a utility fluid with the SCT during hydroprocessing is optional, when used it will generally lead to a further improvement in run length and the blending properties of the hydroprocessed SCT.

EXAMPLES

The following examples are presented as for illustrating embodiments of the present invention and are not to be interpreted as being limiting in any way.

Example 1. Catalyst Preparation

A particulate catalyst is prepared by decomposing a dispersion of phosphomolybdic (PMA) acid in Arabian Light Atmospheric Resid (ALAR) in the presence of $H_2S$, and then removing the particulate catalyst from the oil by filtration. An autoclave is charged with 100 g of ALAR and the appropriate amount of PMA dispersed in the oil was added. The autoclave is heated to 150° C., after which the autoclave is charged to 100 psi with $H_2S$ while stirring and holding the mixture at temperature for 30 min. Thereafter, the autoclave is flushed with hydrogen and heated to 280° C. under 1000 psi (69 barg) of static molecular hydrogen. A molecular hydrogen flow is started at 0.45 L/min while heating the autoclave to 390° C., and held at these conditions for one hour. After cooling to 150° C., the autoclave is vented and the contents filtered and washed with toluene to remove residual oil. The filtered solids (catalyst), designated PMA/ALAR is analyzed for molybdenum content, which is found to be 20-30% molybdenum on carbon derived from the ALAR.

Example 2. General Conversion Procedure

A typical conversion procedure is described here. A 300 cc autoclave is charged with 118 g of SCT feed stock, and amount of the catalyst of Example 1 to provide a molybdenum content in the range of from 10 ppmw to 1000 ppmw, based on the weight of the SCT. The autoclave is flushed out with hydrogen and heated to 200° C. under static molecular hydrogen pressure. A molecular hydrogen flow 0.45 L/min is started to prevent hydrogen starvation. The molecular hydrogen pressure, final temperature and time (run severity) are selected to achieve the extent of conversion desired. The mixture of SCT and particulate catalyst is stirred during the reaction to insure adequate mass transfer of hydrogen. Lighter liquids produced by the hydroprocessing (those having an atmospheric boiling point≤650° F. (≤343° C.) are collected during the reaction in a chilled knockout (KO) vessel downstream of the autoclave. The autoclave is cooled after the hydroprocessing is finished. Gas make is low since high severity is not needed to produce the hydroconverted SCT. After cooling to 120° C. the hydroconverted SCT is removed, and the catalyst and any toluene insolubles (coke) produced, (usually zero) are removed by filtration. Because of the low severity, gas make is less than 2%. Light liquids from the KO are added back to the hydroconverted SCT before analyzing for tar quality.

Example 3. Conversion of SCT to Reduce Viscosity and Convert Asphaltenes. (Heptane Insolubles)

The catalyst of Example 1 is used for hydroprocessing SCT under the conditions of Example 2, as shown in the Table.

TABLE 1

| | SCT Chargestock | A | B | C | D | E | F |
|---|---|---|---|---|---|---|---|
| Chargestock | | | | | | | |
| Total Eq. Severity @ 875° F. (seconds) | | 100 | 100 | 100 | 400 | 500 | 100 |
| Temperature, ° C. | | 400 | 400 | 400 | 415 | 425 | 380 |
| H2 Pressure, psig | | 800 | 800 | 500 | 800 | 800 | 800 |
| Catalyst Particle | | NO CATALYST | $MoS_2$ | $MoS_2$ | $MoS_2$ | $MoS_2$ | $MoS_2$ |
| Molybdenum content (ppmw) | | 0 | 1000 | 1000 | 1000 | 1000 | 1000 |
| H2 Flow rate, cc/min | | 400 | 400 | 400 | 400 | 400 | 400 |
| % 1050° F. + Remaining (wt.) | 20 | 13 | 11 | 11 | 9 | 8.1 | 9.7 |
| % 1050° F. + Conversion (wt.) | 0 | 35 | 45 | 45 | 55 | 59.5 | 51.5 |
| Elemental Analysis TLP | | | | | | | |
| % C (wt.) | 90.45 | 90.48 | 89.84 | 90.22 | 90.11 | 90.03 | 90.01 |
| % H (wt.) | 7.19 | 6.93 | 7.79 | 7.44 | 7.86 | 7.47 | 7.77 |
| % N (wt.) | 0.12 | 0.21 | 0.32 | 0.15 | 0.36 | 0.26 | 0.25 |
| % S (wt.) | 2.19 | 2.13 | 1.89 | 2.07 | 1.65 | 1.77 | 1.81 |
| % C7 Insolubles (wt.) | 22.6 | 22.77 | 6.9 | 6.49 | 6.08 | 6.97 | 5.8 |
| % C7 Insoluble Conversion (wt.) | 0 | 0 | 69.4 | 71 | 73.1 | 69.1 | 74.3 |
| % 25/75 Heptol Insolubles(wt.) | 1 | 8.08 | 0.09 | 0.68 | 0.28 | 0.74 | 0.19 |
| Viscosity cSt @ 50° C. | 988 | 141.3 | 28.4 | 26.99 | 16.8 | 15 | 27.98 |
| Solubility Blending # ($S_{BN}$) | 140 | 192 | 170 | 148 | 170 | 168 | 172 |
| Insolubility # ($I_N$) | 92 | 142 | 92 | 80 | 92 | 109 | 84 |
| Remarks | | Blank Run | | Low Pressure | Higher Severity | Higher Severity | Lower Temperature |

The hydroprocessing results illustrate the following:

1) Hydroconversion without catalyst (A) does not convert heptane insolubles and makes more of the least-soluble asphaltene molecules (25/75 heptol insolubles), making the product less suitable for blending with heavy oil. Viscosity and 1050° F.+(565° C.+) conversion is less than the product obtained with catalyst (B) at similar thermal severity.

2) Conversion is not appreciably lessened, even at hydrogen pressures as low as 500 psig (B vs C at 800 psig).

3) Conversion can be achieved at hydroprocessing temperatures in the range of from 380° C. to 425° C. It can be seen that the most preferred range is 380° C. to 400° C. for the SCT utilized in this example. (F & B vs D & E), while slightly higher viscosity reduction and 1050° F.+ conversion can be achieved at temperatures greater than 400° C., the product suffers from growing insolubility of the unconverted material.

4) Elemental analysis of the total product shows only modest hydrogen consumption owing to the nature of the catalyst selected and the conditions selected for conversion.

5) No additional coke (toluene insolubles) is produced, except for the blank run (A), which did not use catalyst.

The invention claimed is:

1. A process for upgrading pyrolysis tar, which process comprises conducting a chargestock comprising pyrolysis tar, without added solvent or utility fluid, to a hydroprocessing zone and reacting the chargestock in the hydroprocessing zone in the presence of a hydrogen-containing gas at hydroprocessing conditions including a temperature of from about 380° C. to about 425° C. and a hydrogen partial pressure of from about 34 bar gauge to about 82 bar gauge, which chargestock, during hydroconversion, has dispersed therein, in particulate form, a transition metal sulfide catalyst, wherein (i) the transition metal content is from about 10 ppmw to about 1000 ppmw, based on the weight of the chargestock and (ii) the transition metal is selected from groups 4 to 10 of the Periodic Table of the Elements.

2. The process of claim 1, further comprising forming at least a portion of the transition metal sulfide catalyst in a pretreatment solution during a pretreatment, separating the formed catalyst from the pretreatment solution, and then introducing at least a portion of the separated catalyst into the chargestock, wherein the pretreatment comprises (a) combining at least one oil-soluble transition metal compound of the transition metal with a pretreatment solvent and (b) reacting the resulting pretreatment solution with a sulfur-containing material at a temperature of about 325° C. to about 415° C.

3. The process of claim 2, wherein the oil-soluble transition metal compound is selected from the group consisting of inorganic metal compounds, salts of organic acids, organometallic compounds, salts of organic amines, and mixtures thereof.

4. The process of claim 2, wherein said oil-soluble transition metal compound is selected from the group consisting of salts of acyclic aliphatic carboxylic acids, salts of alicyclic aliphatic carboxylic acids, and mixtures thereof.

5. The process of claim 2, wherein the oil-soluble transition metal compound is naphthenic acid salt.

6. The process of claim 2, wherein the metal constituent of the oil-soluble transition metal compound is selected from the group consisting of molybdenum, chromium, vanadium, and mixture thereof.

7. The process of claim 2, wherein the oil-soluble transition metal compound is molybdenum naphthenate.

8. The process of claim 2, wherein the oil soluble transition metal compound is phosphomolybdic acid.

9. The process of claim 1, wherein at least a portion of the transition metal sulfide catalyst is formed in-situ in the chargestock by directly introducing an effective amount of an oil-soluble transition metal compound into the chargestock and subjecting the resulting mixture to the hydroprocessing conditions.

10. The process of claim 9, wherein the hydrogen-containing gas, contains an amount of hydrogen sulfide that is effective for sulfiding the transition metal sulfide catalyst.

11. The process of claim 10, wherein the effective amount of hydrogen sulfide is from about 1 to about 90 mole percent.

12. The process of claim 11, wherein the effective amount of hydrogen sulfide is from about 1 to about 10 mole percent.

13. The process of claim 1, wherein the hydroprocessing conditions include a hydrogen partial pressure of from about 54 bar gauge to 68 bar gauge.

14. The process of claim 1, wherein the metal constituent of the transition metal sulfide catalyst is selected from the group consisting of molybdenum, chromium, vanadium, and mixtures thereof.

15. The process of claim 1, wherein the metal constituent of the transition metal sulfide catalyst is molybdenum.

16. The process of claim 1, wherein the pyrolysis tar is steam cracker tar, the steam cracker tar having an aromatic carbon content of about 70 wt. % to about 80 wt. %, based on the weight of the steam cracker tar.

17. The process of claim 1, wherein the pyrolysis tar is steam cracker tar and has an aliphatic carbon content of about 20 wt. % to 30 wt. %, based on the weight of the steam cracker tar.

18. The process of claim 1, wherein the pyrolysis tar comprises ≥90.0 wt. % of molecules having an atmospheric boiling point greater than 290° C.

19. A process for upgrading steam cracker tar, which process comprises:

(a) providing a chargestock comprising steam cracker tar, without added solvent or utility fluid;

(b) adding to the chargestock an oil-soluble transition metal compound in an amount in the range from about 10 to about 1000 weight parts per million, based on the weight of the chargestock, the transition metal being selected from the group consisting of molybdenum, chromium, vanadium, and mixtures thereof;

(c) reacting the chargestock containing the oil-soluble transition metal compound in a hydroprocessing zone at hydroprocessing conditions including a temperature in the range of from about 380° C. to about 425° C. and a hydrogen partial pressure in the range of from about 34 bar gauge to about 82 bar gauge, to (i) form a transition metal sulfide catalyst in-situ during the hydroprocessing and (ii) produce a hydroprocessor effluent comprising (A) a gaseous phase, (B) hydroprocessed pyrolysis tar, and (C) catalytic solids; and (d) recovering the hydroprocessed pyrolysis tar.

20. The process of claim 19, wherein the hydroprocessing conditions include a hydrogen partial pressure of from about 54 bar gauge to 68 bar gauge.

21. The process of claim 19, wherein the oil-soluble transition metal compound is selected from the group consisting of inorganic metal compounds, salts of organic acids, organometallic compounds, salts of organic amines, and mixtures thereof.

22. The process of claim 19, wherein the oil-soluble transition metal compound is selected from the group consisting of salts of acyclic aliphatic carboxylic acids, salts of alicyclic aliphatic carboxylic acids, and mixtures thereof.

23. The process of claim 19, wherein the oil-soluble transition metal compound comprises naphthenic acid salt.

24. The process of claim 19, wherein the metal constituent of the transition metal sulfide catalyst is molybdenum.

25. The process of claim 19, wherein the steam cracker tar is produced in a steam cracker which includes at least one vapor/liquid separator.

* * * * *